US006358119B1

(12) United States Patent
Shih et al.

(10) Patent No.: US 6,358,119 B1
(45) Date of Patent: Mar. 19, 2002

(54) WAY TO REMOVE CU LINE DAMAGE AFTER CU CMP

(75) Inventors: Tsu Shih, Hsin-Chu; Jih-Churng Twu, Chung-Ho; Ying-Ho Chen, Taipei; Syun-Ming Jang, Hsin-Chu, all of (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 09/336,808

(22) Filed: Jun. 21, 1999

(51) Int. Cl.[7] ..... B24B 1/00

(52) U.S. Cl. ..... 451/36; 451/41; 451/53; 451/449; 451/488; 451/550

(58) Field of Search ..... 451/36, 41, 53, 451/59, 63, 285–290, 449, 488, 550; 438/692, 693

(56) References Cited

U.S. PATENT DOCUMENTS 4,471,579 A * 9/1984 Bovensiepen
4,954,142 A * 9/1990 Carr et al.
5,084,071 A * 1/1992 Nenadic et al.
5,187,119 A 2/1993 Cech et al. ..... 437/187
5,300,155 A 4/1994 Sandhu et al. ..... 148/33
5,607,718 A 3/1997 Sasaki et al. ..... 427/97
5,676,587 A * 10/1997 Landers et al.
5,679,064 A * 10/1997 Nishi et al.
5,690,540 A * 11/1997 Elloitt et al.
5,718,620 A * 2/1998 Tanaka et al.
5,770,095 A 6/1998 Sasaki et al. ..... 216/38
5,775,980 A * 7/1998 Sasaki et al.
5,780,358 A 7/1998 Zhou et al. ..... 438/645
5,780,406 A * 7/1998 Honda et al.
5,840,629 A 11/1998 Carpio ..... 438/692
5,873,769 A * 2/1999 Chiou et al.
6,000,997 A * 12/1999 Kao et al.
6,095,898 A * 8/2000 Hennhofer et al.
6,139,763 A * 10/2000 Ina et al.

* cited by examiner

*Primary Examiner*—Timothy V. Eley
(74) *Attorney, Agent, or Firm*—George O. Saile; Stephen B. Ackerman

(57) ABSTRACT

The invention provides a method and an apparatus that prevent the accumulation of copper ions during CMP of copper lines by performing the CMP process at low temperatures and by maintaining this low temperature during the CMP process by adding a slurry that functions as a corrosion inhibitor.

9 Claims, 1 Drawing Sheet

WAY TO REMOVE CU LINE DAMAGE AFTER CU CMP

BACKGROUND OF THE INVENTION (1) Field of the Invention

The invention relates to the fabrication of integrated circuit devices, and more specifically to a method and apparatus to eliminate copper line damage after copper line Chemical Mechanical Polishing.

(2) Description of the Prior Art

The use of copper has become increasingly more important for the creation of multilevel interconnections in semiconductor circuits, however copper lines frequently show damage after CMP and clean. This damage of copper lines causes planarization problems of subsequent layers that are deposited over the copper lines because these layers may now be deposited on a surface of poor planarity. Particularly susceptible to damage are isolated copper lines or copper lines that are adjacent to open fields. While the root causes for these damages are at this time not clearly understood, poor copper gap fill together with subsequent problems of etching and planarization are suspected. Where over-polish is required, the problem of damaged copper lines becomes even more severe. The present invention teaches methods for avoiding the observed phenomenon of damaged copper lines.

Recent applications have successfully used copper as a conducting metal line, most notably in the construct of CMOS 6-layer copper metal devices. Even for these applications however, a wolfram plug was still used for contact points in order to avoid damage to the devices.

The reliability of a metal interconnect is most commonly described by a lifetime experiment on a set of lines to obtain the medium time to failure. The stress experiment involves stressing the lines at high current densities and at elevated temperatures. The failure criterion is typically an electrical open for non-barrier conductors or a predetermined increase in line resistance for barrier metalization.

The mean time to failure is dependent on the line geometry where this failure is directly proportional to the line width and the line thickness. Experimentally, it has been shown that the width dependence is a function of the ratio of the grain size d of the film and the width of the conductor w. As the ratio w/d decreases, the mean time to failure will increase due to the bamboo effect.

Conventional methods proposed for placing copper conductors on silicon based substrates are based on the deposition of a variety of layers where each layer has characteristics of performance or deposition that enhance the use of copper as the major component within conducting lines. This approach has met with only limited success and has as yet not resulted in the large-scale adaptation of copper.

U.S. Pat. No. 5,187,119 teaches that, in the field of high density interconnect technology, many integrated circuit chips are physically and electrically connected to a single substrate. To achieve a high wiring and packing density, it is necessary to fabricate a multilayer structure on the substrate to connect integrated circuits to one another. Embedded in other dielectric layers are metal conductor lines with vias (holes) providing electrical connections between signal lines or to the metal power and ground planes. Adjacent layers are ordinarily formed so that the primary signal propagation directions are orthogonal to each other. Since the conductor features are typically narrow in width and thick in a vertical direction (in the range of 5 to 10 microns thick) and must be patterned with microlithography, it is important to produce patterned layers that are substantially flat and smooth (i.e., planar) to serve as the base for the next layer.

Two common techniques used to achieve planarity on a semiconductor surface are a Spin-On-Glass (SOG) etchback process and a Chemical Mechanical Polishing (CMP) process. Although both processes improve planarity on the surface of a semiconductor wafer, CMP has been shown to have a higher level of success in improving global planarity. The assurance of planarity is crucial to the lithography process, as the depth of focus of the lithography process is often inadequate for surfaces which do not have a consistent height.

U.S. Pat. No. 5,187,119 further teaches that, if the surface is not flat and smooth, many fabrication problems occur. In a multilayer structure, a flat surface is extremely important to maintain uniform processing parameters from layer to layer. A non-flat surface results in photoresist thickness variations that require pattern or layer dependent processing conditions. The layer dependent processing greatly increases the problem complexity and leads to line width variation and reduced yield. Thus, in fabricating multilayer structures, maintaining a flat surface after fabricating each layer allows uniform layer-to-layer processing.

A further critical consideration for obtaining high yields and suitable performance characteristics of semiconductor devices is that, during the fabrication process, the cleanliness of the silicon wafers is meticulously maintained. It is therefore important to, at all stages of the fabrication process, remove impurities from the surface of the wafer in order to prevent the diffusion of impurities into the semiconductor substrate during subsequent high-temperature processing. Some impurities are donor or acceptor dopants that directly affect device performance characteristics. Other impurities cause surface or bulk defects such as traps, stacking faults or dislocations. Surface contaminants such as organic matter, oil or grease lead to poor film adhesion. The various types of impurities and contaminants must be removed by careful cleaning, such as chemical or ultrasonic cleaning at initiation of silicon processing and in various appropriate steps during processing.

Chemical Mechanical Polishing is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials therein, is maintained on the polishing pad to modify the polishing characteristics of the polishing pad in order to enhance the polishing of the substrate.

A common requirement of all CMP processes is that the substrate be uniformly polished. In the case of polishing an electrical insulating layer, it is desirable to polish the layer uniformly from edge to edge on the substrate. To ensure that a planar surface is obtained, the electrically insulating layer must be uniformly removed. Uniform polishing can be difficult because several machine parameters can interact to create non-uniformity in the polishing process. For example, in the case of CMP, misalignment of the polishing wheel with respect to the polishing platen can create regions of non-uniform polishing across the diameter of the polished surface. Other machine parameters, such as non-homogeneous slurry compositions and variations in the platen pressure, can also create non-uniform polishing conditions.

U.S. Pat. No. 5,770,095 (Sasaki et al.) teaches Cu CMP methods that include low temperature CMP (temp ranges −2 degrees C. to 100 degrees C.) and various slurries that appear to include inhibitors. See cols. 5 13, examples 1 to 4. FIG. 13 appears to show a chiller for a CMP platen, see col. 12, line 49.

U.S. Pat. No. 5,607,718 (Sasaki et al.) discloses a Cu CMP method at a low temperature (less than 15 degrees C.), see claims 2, 16, etc.

U.S. Pat. No. 5,840,629 (Carpio) shows a Cu CMP slurry composition including corrosion inhibitors, see col. 3, lines 21 to 30.

U.S. Pat. No. 5,300,155 (Sandu et al.) discloses a CMP method where a metal is CMP at different temperatures. This patent has broad claims.

U.S. Pat. No. 5,780,358 (Zhou et al.) teaches a Cu CMP method, which include anti-oxidation (inhibitors), see col. 8, lines 40 to 49.

SUMMARY OF THE INVENTION

It is the primary objective of the invention to reduce copper line damage after copper Chemical Mechanical Polishing.

It is another objective of the present invention to reduce the defect count for copper line polishing using the CMP process.

It is another objective of the present invention to improve semiconductor wafer throughput as a result of copper line polishing using the CMP process.

It is another objective of the present invention to improve copper line reliability and the related reliability of the devices contained within the semiconductor wafer.

It is another objective of the invention to provide a method of copper line polishing that can realize a high semiconductor wafer throughput and that exhibits uniformity and planarity of the surface of the copper line that is to be polished.

In accordance with the objects of the invention a new method of polishing copper lines is achieved. The object of copper CMP is to remove copper ions in a continuous and uninterrupted manner. Copper ions, if allowed to accumulate, will cause corrosion of the copper lines. This implies that, during the process of CMP, no copper ions accumulation must be allowed. The invention achieves the prevention of the accumulation of copper ions by performing the CMP process at low temperatures and by maintaining this low temperature during the CMP process by adding a slurry that functions as a corrosion inhibitor.

DESCRIPTION OF THE PREFERRED EMBODIMENT

Figure 1:
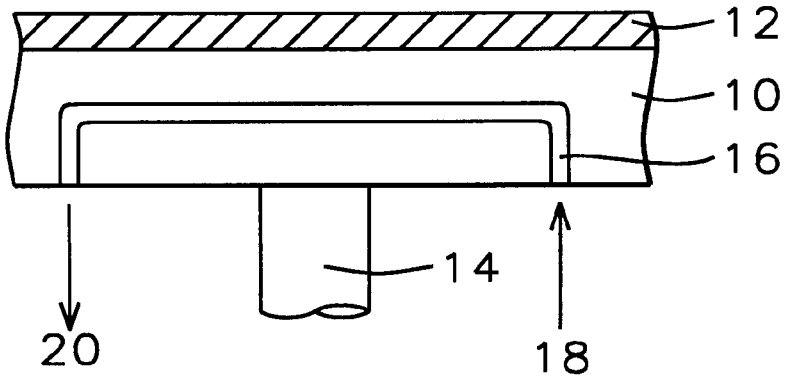
FIG. 1 shows a cross section of the polishing plate used for the copper CMP process.

Referring now specifically to FIG. 1, there is shown a cross section of the polishing platen 10 that is used to polish the copper lines contained within the surface of wafer 12. Affixed to the polishing table 10 is a polishing pad (not shown) that is in direct physical contact with the wafer 12 that is being polished. The polishing plate 10 rotates around an axis of rotation 14. A channel 16 is provided through the body of platen 10, through this channel water is entered as indicated by the direction 18 of the inhibitor. This water exits the platen 10 as indicated by 20. The water supply is used to control the temperature of the platen 10 and does not exit the platen on the surface of the platen that comes into contact with the copper lines that are being polished. The water serves the function of controlling the temperature of the polishing platen 10, this temperature is targeted to remain around 22 degrees C. but may, dependent on the intensity of polishing actions, rise to around 28 degrees C.

The objective of the cooling arrangement is to keep the temperature at the surface of the polishing platen within the range of between 10 and 20 degrees C., best results of preventing the build-up of copper ions on the surface of the polishing platen will be obtained if the temperature on the surface of the polishing platen is kept within the 10 to 20 degrees C. range.

Equally important to the invention is the use of slurry that inhibits the accumulation of copper ions on the surface of the wafer that is being polishing. Typical slurry used under the invention is slurry with a pH of less than 7. A slurry that can be used for this purpose preferably comprises benzotriazol or ethylenediaminetetraacetic acid (EDTA).

The invention can be implemented using one of the various silicon wafer-cleaning systems that are commercially available which clean wafers using mechanical scrubbing. These conventional silicon wafer cleaning machines use a polishing pad affixed to a rotating turntable wherein the polishing pad faces upward as shown in FIG. 1. The turntable is commonly rotated at various controlled speeds, for instance 10 to 100 RPM, in a controlled clockwise or counterclockwise direction. The silicon wafer, generally in the form of a flat, circular disk, is held within a carrier assembly (not shown) with the substrate wafer face to be polished facing downward. The polishing pad and turntable are typically much larger that the silicon wafer. For example, a typical diameter of the pad (not shown) and turntable 10 is 22 inches while the wafer commonly has a diameter of approximately 10 inches. The polishing pad is typically fabricated from a polyurethane and/or polyester base material. Semiconductor polishing pads are commercially available such as models IC1000 or Scuba IV of a woven polyurethane material.

Figure 2:
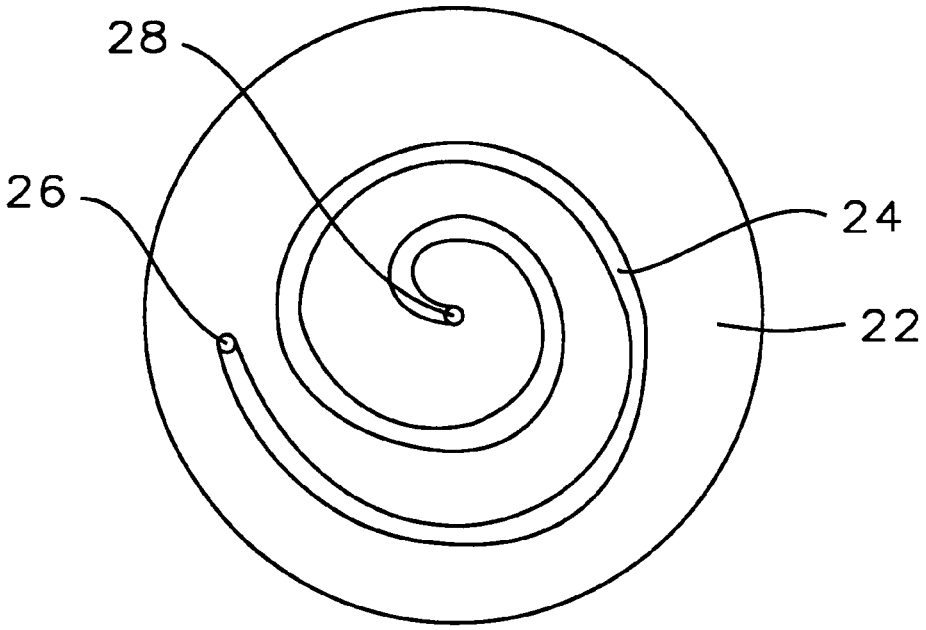
FIG. 2 shows a top view of the surface of the polishing platen that is in contact with the copper lines that are being polished.

FIG. 2 shows another arrangement for routing the cooling water through the polishing platen 22. Controlling the temperature at the surface of the wafer that is being polished is of key importance to the prevention of the accumulation of copper ions on that surface. This requires that a maximum amount of the heat created during the polishing operation be removed in a direct and efficient manner. This efficiency can be increased by increasing the area of contact between the coolant (water) and the body of the polishing platen. The design shown in FIG. 2 accomplishes this indicated maximization of contact and, in so doing, provides and efficient manner of preventing the temperature at the surface of the substrate that is being polished from exceeding the limit required for optimum results. The design shown in FIG. 2 also provides better temperature uniformity across the surface of the wafer that is being polished since the coolant contacts the body of the polishing platen over a large cross section of the platen. The coolant that is provided to the polishing platen 22 is circulated through the polishing platen 22 via a helix or spiral 24. The spiral 24 provides maximum contact between the coolant and the polishing platen 22 thereby allowing maximum impact of the coolant on the temperature and temperature control of the polishing platen 22. A port 26 for entry of coolant and a separate port 28 for exit of coolant are provided. By providing the entry and exit points at unequal distances from the center of the polishing platen 22, the temperature gradient of the surface of the polishing platen can be further controlled. The coolant can enter the spiral 24 at the point of highest temperature of the polishing platen thereby removing thermal energy from the polishing table in the most efficient manner.

From the invention it is clear that, because the temperature of a wafer is typically higher at the center of the wafer than it is at the edge of the wafer, the cooling system must take this temperature characteristic into account. This means that cooling must be higher in the center of the wafer which in turn means that the heat that is removed from the center of the wafer is higher than the heat that is removed from the edge of the wafer. This objective can be accomplished by increasing the density of the helix that is created in the polishing platen so that the concentration of the coolant is densest in the center of the wafer that is being polished. The density of the helix along the diameter of the polishing platen and the gradient of increasing or decreasing the density of the helix can readily be determined for particular applications and different wafer diameters. It is clear that the heat exchange in the center of the wafer must be high relative to the heat exchange at the edge of the wafer, the density of the openings that are created for the helix inside the polishing platen must therefor accommodate this heat exchange profile by having higher density tubing in the center with gradually decreasing density of tubing towards the edge of the polishing plate.

The density of the helix coil 24 within the body of the polishing platen 22 can be defined as the number of times that a radius that is extended from the center 28 of the polishing platen 22 to the perimeter of the polishing platen 22 crosses the helix coil 24. For instance, a radius extending from the center 28 of the polishing platen 22 towards the perimeter of the polishing platen 22 may cross the helix coil "n" times in the first "m" inches of this extension. A decrease in density of the helix coil 24 in going from the center 28 of the polishing platen 22 to the perimeter can then be explained as follows. For every "m" inches that the extension is increased in the direction from the center 28 of the polishing platen 22 towards the perimeter of polishing platen 22, the number "n" decreases, meaning that fewer crossings of the coils occur along the radius of the polishing platen for extensions "m" that are further removed from the center 28 of polishing platen 22. Fewer crossings when proceeding from the center of the polishing platen 22 towards the perimeter of the polishing platen 22 can be referred to as a decrease in density in the coils when proceeding from the center 28 of the polishing platen 22 towards the perimeter of the polishing platen 22.

It will be apparent to those skilled in the art, that other embodiments, improvements, details and uses can be made consistent with the letter and spirit of the present invention and within the scope of the present invention, which is limited only by the following claims, construed in accordance with the patent law, including the doctrine of equivalents.

What is claimed is:

1. A method for polishing copper lines within the structure of a semiconductor device, comprising the steps of:

providing a semiconductor substrate, said semiconductor substrate having been provided with a pattern of copper wires, said pattern of copper wires being on the surface of said semiconductor substrate;

providing a polishing apparatus, said polishing apparatus having been provided with a polishing platen, said polishing platen having a surface, said polishing platen comprising a channel, said channel being a straight line, said channel being contained within said polishing platen as a channel internal to the polishing platen without exposure of said channel in a surface of said polishing platen, said channel having a port for entry of coolant and a separate port for exit of coolant, said port for entry of coolant and said port for exit of coolant being located in a periphery of said polishing platen, said port for entry of coolant and said port for exit of coolant enabling entry and removal of a coolant, said coolant being in direct contact with said polishing platen, said polishing platen furthermore being affixed to a rotating axis thereby enabling said polishing platen to polish the surface of said semiconductor wafer;

providing a slurry for said polishing apparatus; and polishing said pattern of copper wires using said polishing apparatus, said slurry being provided to the surface of said pattern of copper wires during said polishing of said pattern of copper wires.

2. A method for polishing copper lines within the structure of a semiconductor device, comprising the steps of:

providing a semiconductor substrate, said semiconductor substrate having been provided with a pattern of copper wires, said pattern of copper wires being on the surface of said semiconductor substrate;

providing a polishing apparatus, said polishing apparatus comprising a polishing platen, said polishing platen having a surface, said polishing platen comprising a channel, said channel being a spiral within said polishing platen, said channel comprising a port for entry of coolant and a separate port for exit of coolant, said port for entry of coolant and said port for exit of coolant being located in a periphery of said polishing platen, said port for entry of coolant and said port for exit of coolant enabling entry and removal of a coolant, said coolant being in contact with said polishing platen, said polishing platen furthermore being affixed to a rotating axis thereby enabling said polishing platen to polish the surface of said semiconductor wafer;

providing a slurry for said polishing apparatus; and polishing said pattern of copper wires using said polishing apparatus, said slurry being provided to the surface of said pattern of copper wires during said polishing of said pattern of copper wires.

3. The method of claim 2 wherein said providing a slurry for said polishing apparatus is providing benzotriazol.

4. The method of claim 2 wherein said providing a slurry for said polishing apparatus is providing ethylenediaminetetraacetic acid (EDTA).

5. A method for polishing copper lines within the structure of a semiconductor device, comprising the steps of:

providing a semiconductor substrate, said semiconductor substrate having been provided with a pattern of copper wires, said pattern of copper wires being on the surface of said semiconductor substrate;

providing a polishing apparatus, said polishing apparatus comprising a polishing platen, said polishing platen having a surface, said polishing platen comprising a channel, said channel being a spiral within said platen, said spiral having an increasing number of coils when proceeding from a perimeter of said polishing platen to a center of said polishing platen, said number of coils increasing in accordance with a function when going from a perimeter of said polishing platen toward a center of said polishing platen thereby providing higher heat exchange in a center of the polishing table as compared to a perimeter of said polishing platen, said channel having a port for entry of coolant and a separate port for exit of coolant, said port for entry of coolant and said port for exit of coolant being located in a periphery of said platen, said port for entry of coolant and said port for exit of coolant enabling entry and removal of a coolant, said coolant being in contact with said platen, said polishing platen furthermore being affixed to a rotating axis thereby enabling said polishing platen to polish the surface of said semiconductor wafer;

providing a slurry for said polishing apparatus; and polishing said pattern of copper wires using said polishing apparatus, said slurry being provided to the surface of said pattern of copper wires during said polishing of said pattern of copper wires.

6. The method of claim 5 wherein said providing a slurry for said polishing apparatus is providing benzotriazol.

7. The method of claim 5 wherein said providing a slurry for said polishing apparatus is providing ethylenediaminetetraacetic acid (EDTA).

8. The method of claim 1 wherein said providing a slurry for said polishing apparatus is providing benzotriazol.

9. The method of claim 1 wherein said providing a slurry for said polishing apparatus is providing ethylenediaminetetraacetic acid (EDTA).

* * * * *